United States Patent [19]

Quack et al.

[11] 4,242,885

[45] Jan. 6, 1981

[54] APPARATUS FOR A REFRIGERATION CIRCUIT

[75] Inventors: Hans Quack, Pfaffikon; Armin E. Senn, Winterthur, both of Switzerland

[73] Assignee: Sulzer Brothers Limited, Winterthur, Switzerland

[21] Appl. No.: 970,159

[22] Filed: Dec. 18, 1978

[30] Foreign Application Priority Data

Dec. 23, 1977 [CH] Switzerland ..... 15972/77

[51] Int. Cl.[3] ..... F25B 1/06

[52] U.S. Cl. ..... 62/500; 62/514 R

[58] Field of Search ..... 62/116, 191, 500, 514 R

[56] References Cited

U.S. PATENT DOCUMENTS

| | | | |
|---|---|---|---|
| 3,159,008 | 12/1964 | Nebgen | 62/500 |
| 3,427,817 | 2/1969 | Rietdijk | 62/191 |
| 3,434,298 | 3/1969 | Rietdijk | 62/500 |
| 3,442,093 | 5/1969 | Rietdijk | 62/500 |
| 3,447,339 | 6/1969 | Rietdijk | 62/500 |
| 3,456,456 | 7/1969 | Rietdijk | 62/500 |
| 3,464,230 | 9/1969 | Rietdijk | 62/500 |
| 3,496,735 | 2/1970 | Haisma | 62/191 |
| 3,932,158 | 1/1976 | Hildebrandt | 62/500 |

*Primary Examiner*—Ronald C. Capossela

*Attorney, Agent, or Firm*—Kenyon & Kenyon

[57] ABSTRACT

An ejector is used in place of a compressor with moving parts in the refrigeration apparatus. The ejector has an intake side connected to the gas space of a liquefied gas tank, a propellant jet input connected to a delivery side of the compressor to receive a high pressure flow of gas and a delivery side in the form of a diffusor output connected to the intake side of the compressor. A pair of ejectors can be connected in series or, where more than two liquefied gas tanks are used, in parallel.

8 Claims, 5 Drawing Figures

APPARATUS FOR A REFRIGERATION CIRCUIT

This invention relates to an apparatus for a refrigeration circuit. More particularly, this invention relates to an apparatus for refrigeration or for liquefying gases in a refrigeration circuit.

Heretofore, various types of refrigeration circuits have been known for refrigeration or liquefying purposes. Generally, these circuits include a compressor with an after-cooler for compressing a gas, cooling means for at least partially liquefying the gas, and two series-connected tanks for the liquefied gas. The first tank following the cooling means has a gas space connected to the intake side of the compressor while the second tank has a gas space connected to the intake side of a second compressor, the delivery side of which is connected to the intake side of the first compressor. In one known circuit, for example, as described in Proc. 3rd, Int. Cryogenic Engineering Conference, Berlin, May 1970, pages 310–314, Iliffe Science and Techn. Publ. Ltd., the second compressor is a machine having moving parts, such as piston compressors or rotary piston blowers. A disadvantage of using compressors having moving parts for this purpose is that the investment and maintenance costs are relatively high. Further, if the intake pressure of the second compressor is below atmospheric pressure, the compressor may draw air into the refrigeration circuit.

Accordingly, it is an object of the invention to provide an apparatus for a refrigeration circuit which does not require high investment and maintenance costs.

It is another object of the invention to provide a refrigeration circuit which is of relatively simple construction.

It is another object of the invention to simplify the construction of compressors which are used in refrigeration circuits.

Briefly, the invention provides a refrigeration circuit which includes a compressor for compressing a gas, an after-cooler downstream of the compressor for cooling the compressed gas, a cooling means for at least partially liquefying the compressed gas, and a pair of tanks which are connected in series to the cooling means to receive the liquefied gas. In addition, one tank has a gas space connected to the intake of the compressor to recycle the gas back to the compressor.

In accordance with the invention, an ejector is connected on an intake side to a gas space of the second tank to receive gas. The ejector also has a propellant jet input connected to the delivery side of the compressor and a delivery side connected to the intake side of the compressor. The propellant jet input can be connected to the delivery side of the compressor either before or after the after-cooler.

If the pressure that can be produced by means of the ejector in the gas space of the second tank is not low enough to give the required low temperature of the refrigerant in that tank, another ejector can be connected in series with the ejector.

Since the dimensions of an ejector are relatively small, and since an ejector has no moving parts, at least one of the ejectors can be accommodated in a vacuum housing or cold box in which the pressure is lower than the ejector intake pressure. In this way, no extraneous gases can enter the refrigeration circuit.

The apparatus may have more than two tanks for liquid gas. In that case, the vapor chamber of e.g. a third tank is associated with an ejector which is connected in parallel with the preceding ejector.

These and other objects and advantages of the invention will become more apparent from the following detailed description taken in conjunction with the following drawings wherein:

FIG. 1 diagrammatically illustrates a refrigeration apparatus according to the invention;

Figure 1:
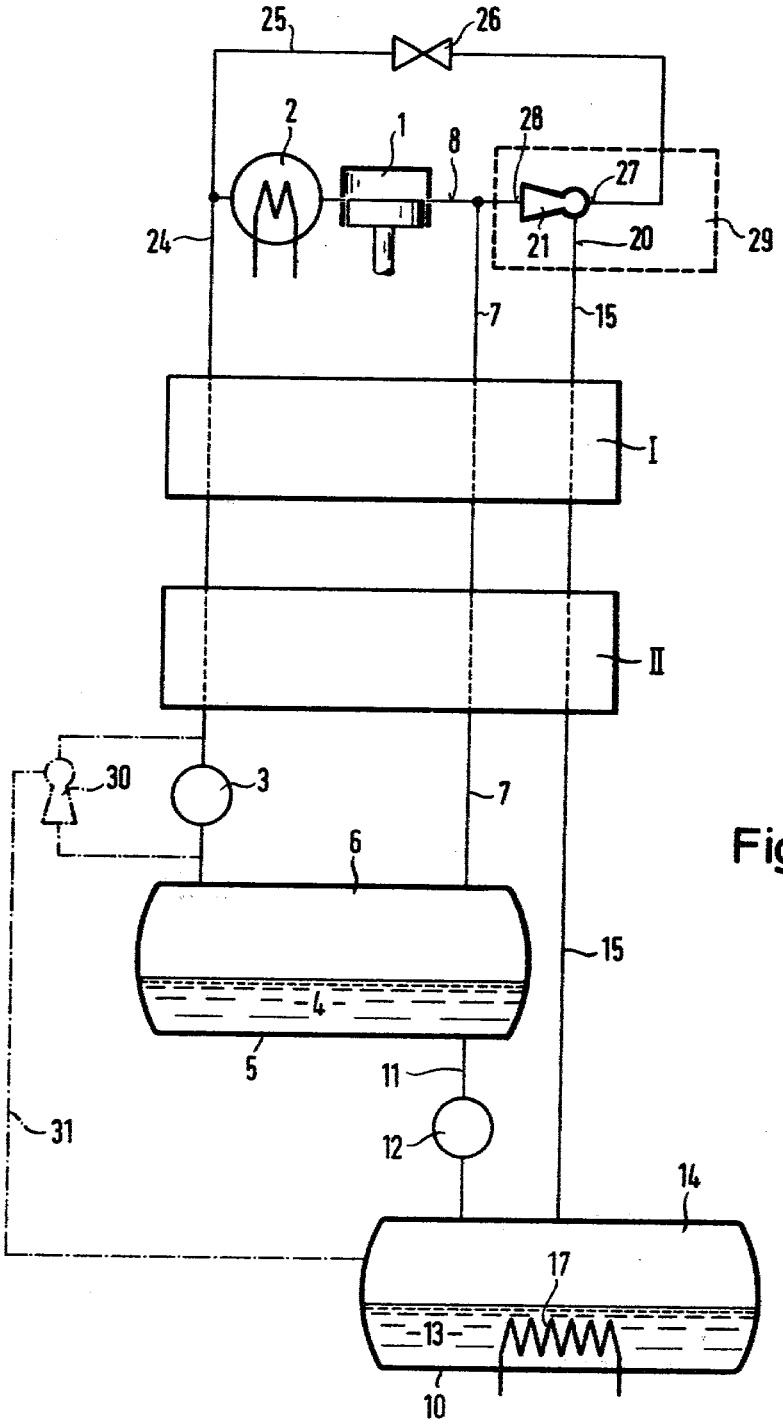

Referring to FIG. 1, the apparatus for a refrigeration circuit has a compressor 1 for compressing a gas such as gaseous helium, an after-cooler 2 downstream of the compressor 1 for cooling the compressed gas, i.e. for dissipating the compression heat, and cooling means in the form of a pre-cooling stage I and a second cooling stage II. The pre-cooling stage I cools the gas to a pre-cooling temperature below its inversion temperature by heat exchange and expansion to perform work. The second pre-cooling stage II serves to cool the pre-cooled helium further by heat exchange following the pre-cooling stage I and then to expand the helium in an expansion valve 3 from high-pressure to liquefaction pressure. The helium is partially liquefied in these conditions.

The apparatus also has a pair of tanks 5, 10 connected in series to the cooling stage II. As indicated, the first tank 5 collects liquid helium which is at a temperature corresponding to the pressure in a gas space 6 of the tank 5. This tank 5, in turn, communicates via a conduit 7, the second cooling stage II and the pre-cooling stage I, with an intake side 8 of the compressor 1. The compressor serves to compress the low-pressure gas drawn from the gas space 6 and to recycle the gas to the circuit.

The second tank 10 receives some of the liquid helium which flows from the tank 5 via a conduit 11. The conduit 11 contains an expansion valve 12, so that the liquid helium 13 flowing into the tank 10 has a lower temperature than that in the tank 5. The temperature of the helium 13 corresponds to the pressure of the gas in a gas space 14 of the tank 10. The gas space 14 of tank 10 communicates via conduit 15 and the two cooling stages II and I with an intake side 20 of an ejector 21. As shown, the ejector 21 has a propellant jet input 27 which is connected to the delivery side of the compressor 1 via a branch line 25 which taps a high-pressure line 24 of the compressor and which contains a suitable valve 26. The ejector also has a delivery side in the form of a diffuser output 28 connected to the intake side 8 of the compressor 1. The propellant for the ejector 21 is the high pressure helium gas which is supplied from the high-pressure line 25 of the compressor 1.

A refrigerant load, e.g. a coil 17 of a super-conductive magnet, may be disposed in one of the tanks 5 or 10, or both, or otherwise the liquid helium from one or both tanks 5, 10 can be used for some other purpose. If it is desired to reduce the temperature of the liquid helium 13 in the tank 10, the valve 26 is opened further to increase the propellant jet in the ejector 21 so that the pressure in the gas space 14 of the tank 10 drops and the liquid helium 13 assumes the required lower temperature.

The branch line 25 for the propellant jet of the ejector 21 branches off after the after-cooler 2. The advantage of this is that no cooler is required for the helium after the ejector 21. Alternatively, the branch line 25 may be branched off upstream of the after-cooler 2, i.e. between the compressor 1 and the after-cooler 2. This has the advantage that the mass flow of the propellant jet for the ejector 21 is smaller. In that case, however, a cooler is advantageously provided between the ejector and the compressor.

If the pressure in the gas space 14 is so low or the pressure drop in the line 15 is so great, that the pressure on the intake side 20 of the ejector is below the external atmospheric pressure, the ejector 21 can be accommodated in a vacuum tank or housing 29. This has the advantage that no extraneous gases can penetrate and be introduced into the refrigerant circuit.

Figure 5:
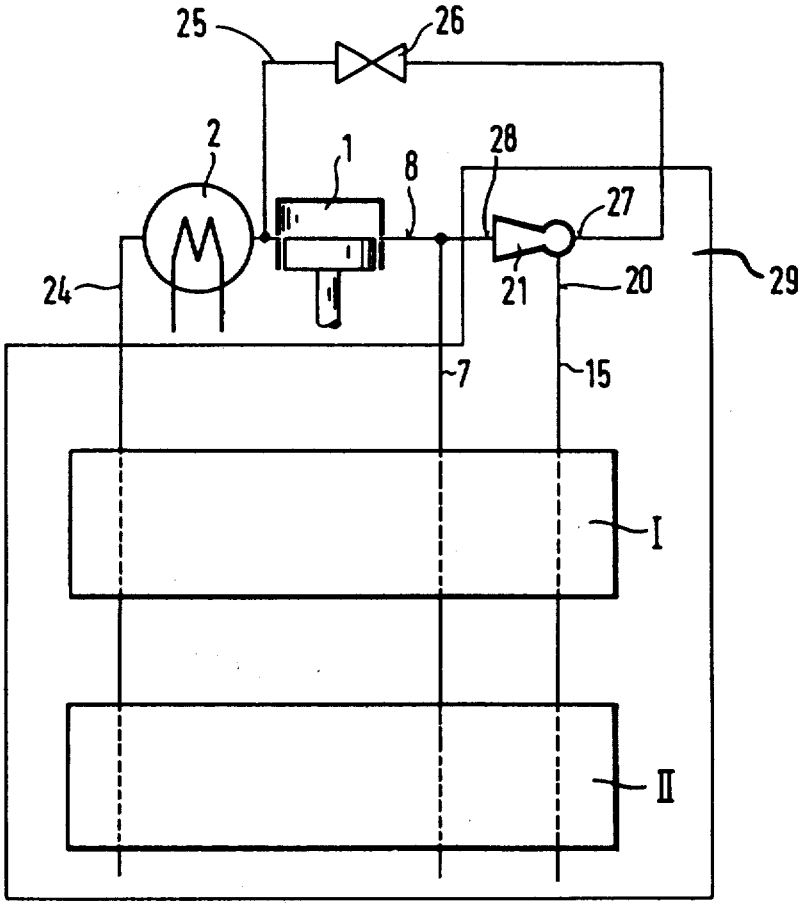
FIG. 5 illustrates a portion of a further modified refrigeration apparatus according to the invention.

This is the reason for another advantage of using an ejector instead of the known compressors with moving parts, since the dimensions of these compressors are too large to be economically accommodated in a vacuum housing. As shown in FIG. 5, wherein like reference characters indicate like parts as above, the vacuum housing 29 may advantageously form part of a "cold box" 29' in which the pre-cooling stages I and II are also accommodated in helium refrigerating plants.

The exemplified embodiment of FIG. 1 illustrated here as a refrigerating apparatus using helium as refrigerant can also be used for refrigeration using other refrigerants and for liquefying helium or other gases. Various constructions are also possible for the cooling stages I and II. If, for example, helium is used as a refrigerant in the main circuit, the cooling stage I can be constructed as a separate nitrogen and/or hydrogen refrigerant circuit. With other refrigerants, e.g. ammonia, cooling stage I, for example, can be completely eliminated while cooling stage II consists of a water-cooled condenser. Also, the intake line 15 need not extend through the cooling stages I and II; instead, the intake line 15 can run separately therefrom.

Figure 2:
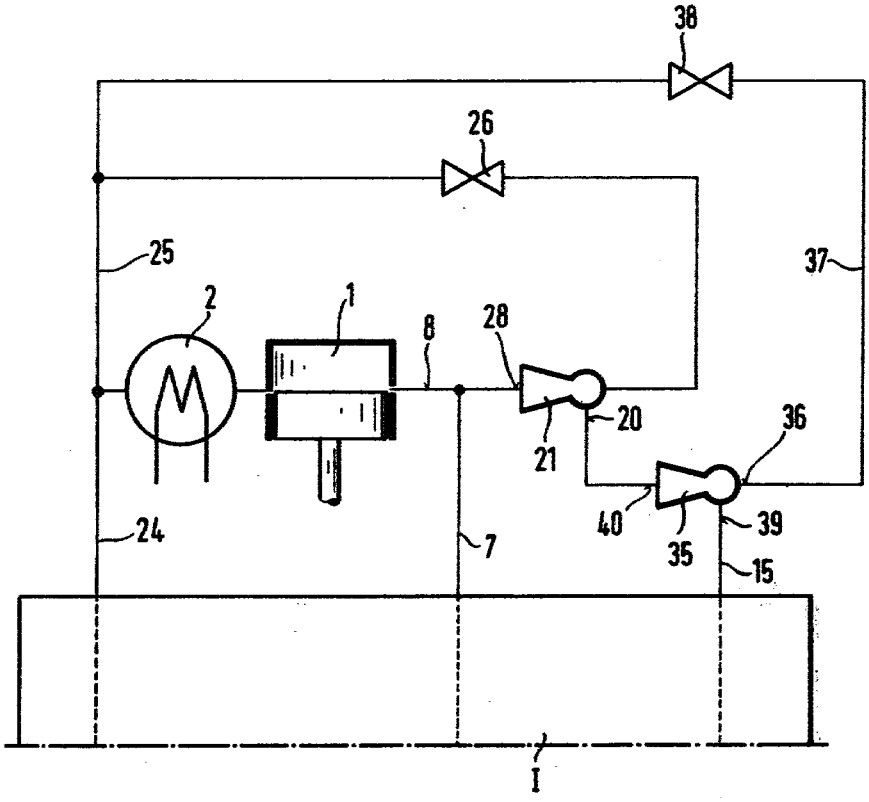
FIG. 2 illustrates a portion of a modified refrigeration apparatus according to the invention.

If the negative pressure that the ejector 21 can produce in the gas space 14 of the tank 10 is not low enough to achieve the required low-temperature of the liquid helium, then, as shown in FIG. 2, a second ejector 35 can be connected in series with the ejector 21. The propellant jet inlet 36 of this ejector 35 is branched off the high-pressure line 24 via a line 37 containing a valve 38. The intake side 39 of the ejector 35 is connected to the line 15 leading to the gas space 14 of the tank 10. The diffusor output 40 on the delivery side of the ejector 35 is connected to the intake side 20 of the ejector 21.

The propellant jet for the ejector 35 is so adjusted by means of the valve 38 that the total power of the two ejectors 21, 35 has the required value.

Figure 3:
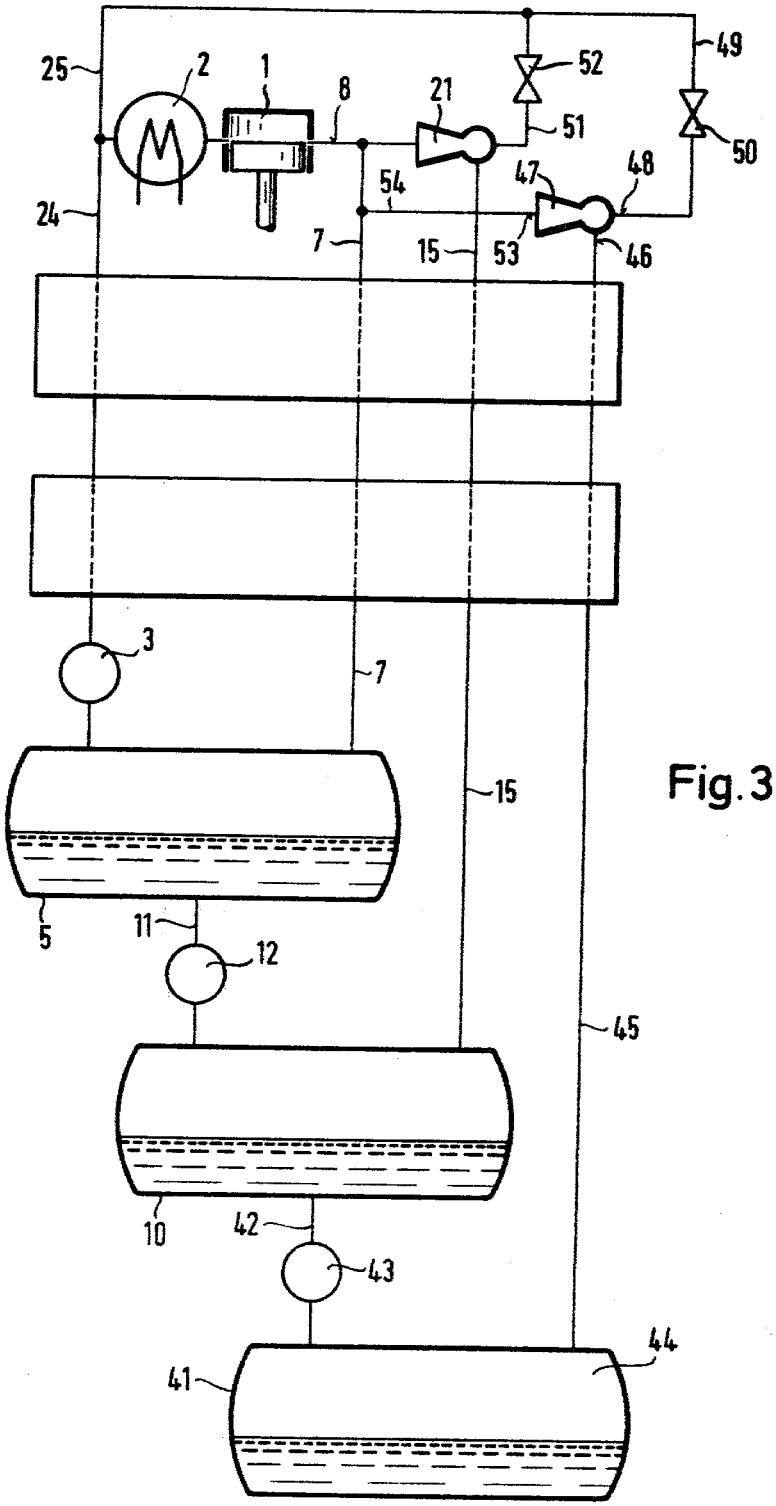
FIG. 3 illustrates a portion of a further modified refrigeration apparatus according to the invention.
Figure 1:
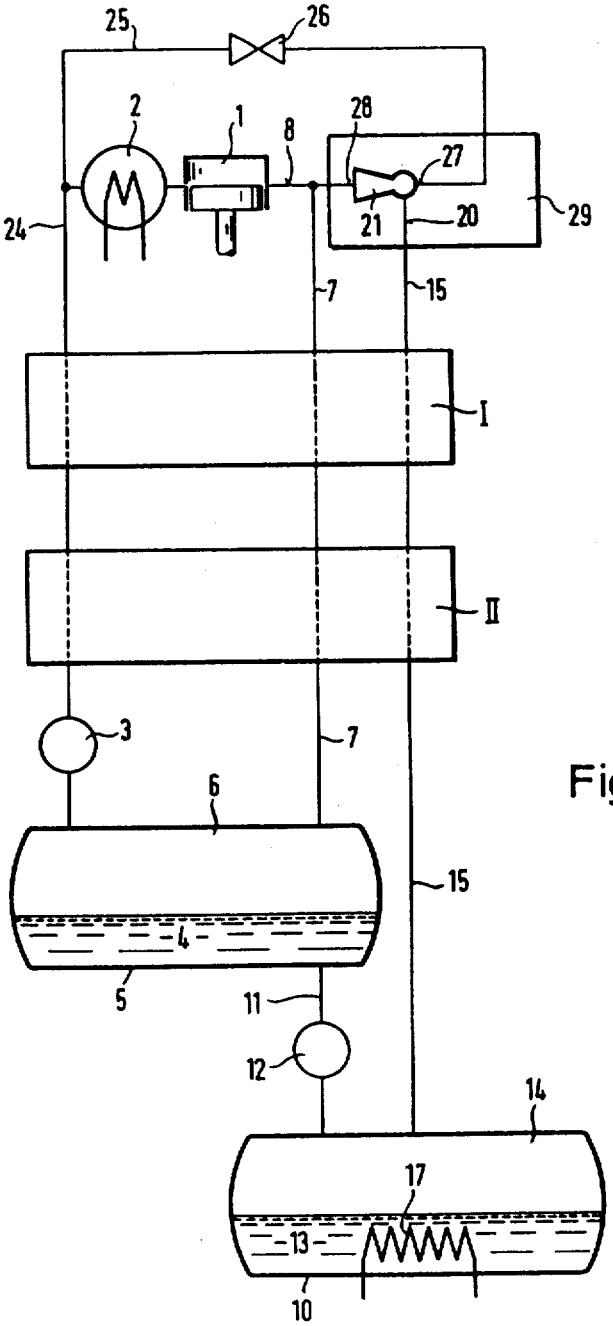

Referring to FIG. 3, wherein like reference characters indicate like parts as above, the apparatus may comprise more than two tanks for liquid helium. For example, the apparatus may have three tanks 5, 10, 41 in series. The third tank 41 follows and is connected to the second tank 10 via a conduit 42 containing an expansion valve 43. A gas space 44 of the tank 41 is connected to an intake side 46 of an ejector 47 via an intake line 45. A propellant jet input 48 of the ejector 47 communicates with the branch line 25 of the compressor 1 via a line 49 containing a valve 50. The propellant jet line 51 of the ejector 21 contains a valve 52 for adjusting the propellant jet pressure. A diffuser output 53 of the ejector 47 communicates with the intake side 8 of the compressor 1 via a line 54 and line 7. The two ejectors 21, 47 are thus in parallel relation. The strength of the propellant jet of the ejector 47 is so adjusted by means of the valve 50 that the diffuser pressure corresponds to the intake pressure in the intake line 7 of the compressor 1. The liquid helium in the tank 41 has a temperature corresponding to the pressure in the intake line 45.

Figure 4:
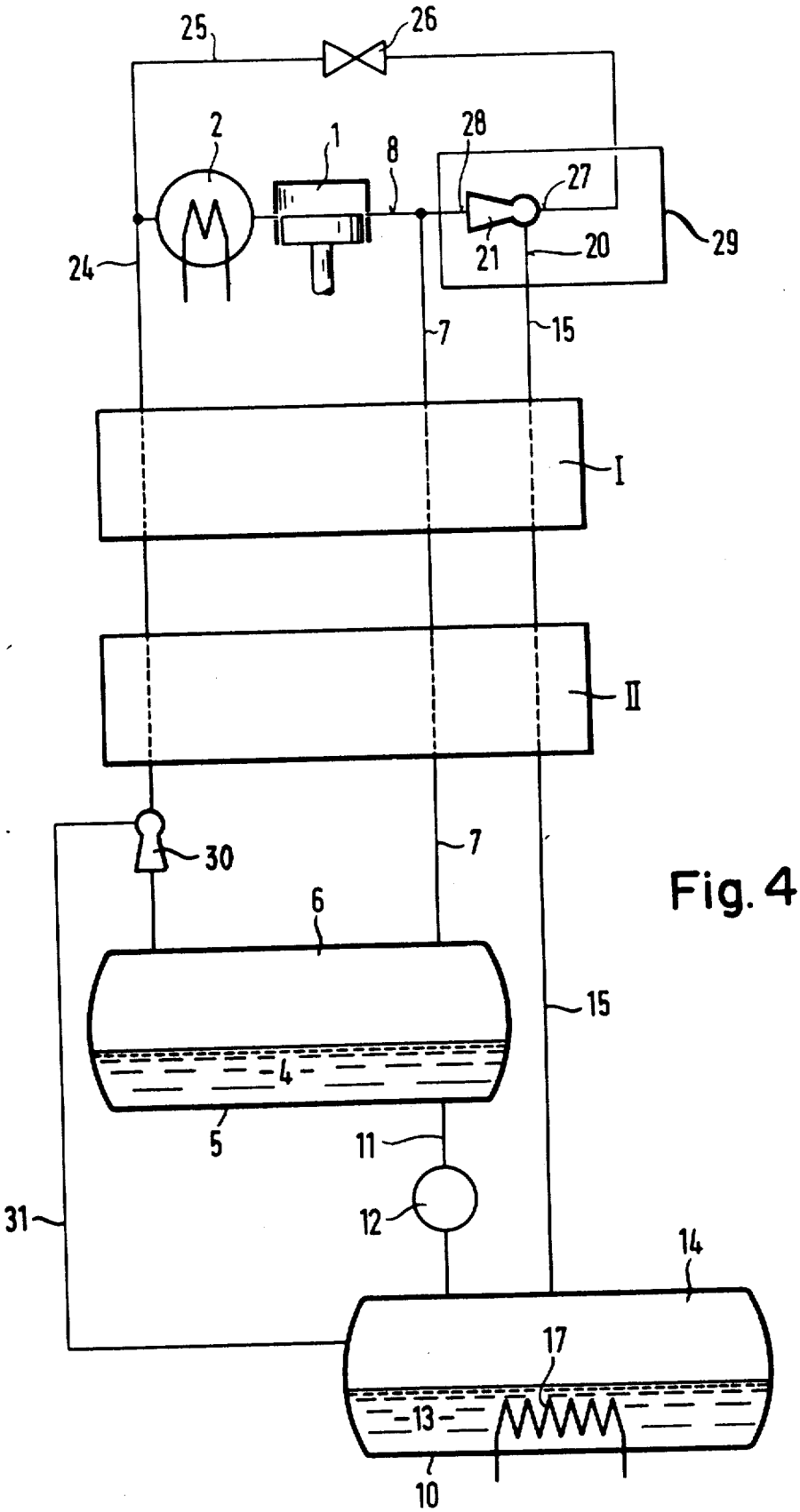
FIG. 4 illustrates a modified refrigeration apparatus according to the invention.

Referring to FIG. 4, wherein like reference characters indicate like parts as above, instead of using the expansion or throttle valve 3 of FIGS. 1 and 3, an ejector 30 may be used as an expansion device. In this case, expansion and partial liquefaction of the high-pressure gas takes place in a propellant nozzle of the ejector 30. Further, it is advantageous to connect the intake side of the ejector 30 via a line 31 to the gas space 14 of the tank 10. This will relieve the ejector 21 of load, so that the ejector 21 can be smaller and require less propellant gas.

What is claimed is:

1. Apparatus for a refrigeration circuit comprising a compressor for compressing a gas, said compressor having an intake side for receiving gas and a delivery side for expelling compressed gas;

an after-cooler downstream of said compressor for cooling the compressed gas;

cooling means downstream of said after-cooler for at least partially liquefying the compressed gas;

a pair of tanks connected in series to said cooling means to receive the at least partially liquefied compressed gas, a first one of said tanks having a gas space connected to said intake of said compressor to recycle gas thereto; and an ejector having an intake side connected to a gas space of the other of said tanks to receive gas therefrom, a propellant jet input connected to said delivery side of said compressor and a delivery side connected to said intake side of said compressor.

2. An apparatus as set forth in claim 1 wherein said propellant jet input is connected to said delivery side of said compressor downstream of said after-cooler.

3. An apparatus as set forth in claim 1 wherein said propellant jet input is connected to said delivery side of said compressor upstream of said after-cooler.

4. An apparatus as set forth in claim 1 which further comprises a second ejector connected in series with said first ejector, said second ejector having an intake side connected to said gas space of said other tank, a propellant jet input connected to said delivery side of said compressor and a delivery side connected to said intake side of said first ejector.

5. An apparatus as set forth in claim 1 which further comprises a vacuum tank housing said ejector.

6. An apparatus as set forth in claim 5 wherein said vacuum tank forms part of a cold box housing said cooling means.

7. An apparatus as set forth in claim 1 wherein said cooling means includes a second ejector for expanding a flow of gas passing therethrough said second ejector having an intake side connected to said gas space of said second tank.

8. An apparatus as set forth in claim 1 which further comprises a third tank connected in series with said pair of tanks, and a second ejector connected in parallel with said first ejector, said second ejector having an intake side connected to a gas space of said third tank, a propellant jet input connected to said delivery side of said compressor and a delivery side connected to said intake side of said compressor.

* * * * *

UNITED STATES PATENT AND TRADEMARK OFFICE

CERTIFICATE OF CORRECTION

PATENT NO. : 4,242,885

DATED : January 6, 1981

INVENTOR(S) : Hans Quack et al

It is certified that error appears in the above-identified patent and that said Letters Patent is hereby corrected as shown below:

The title page and Figs. 1,4 and 5 should appear as shown on the attached sheets.

Signed and Sealed this

*Eighth* Day of *May 1984*

[SEAL]

*Attest:*

GERALD J. MOSSINGHOFF

*Attesting Officer*

*Commissioner of Patents and Trademarks*

United States Patent [19]

Quack et al.

[11] 4,242,885

[45] Jan. 6, 1981

[54] APPARATUS FOR A REFRIGERATION CIRCUIT

[75] Inventors: Hans Quack, Pfaffikon; Armin E. Senn, Winterthur, both of Switzerland

[73] Assignee: Sulzer Brothers Limited, Winterthur, Switzerland

[21] Appl. No.: 970,159

[22] Filed: Dec. 18, 1978

[30] Foreign Application Priority Data

Dec. 23, 1977 [CH] Switzerland ..... 15972/77

[51] Int. Cl.[3] ..... F25B 1/06

[52] U.S. Cl. ..... 62/500; 62/514 R

[58] Field of Search ..... 62/116, 191, 500, 514 R

[56] References Cited

U.S. PATENT DOCUMENTS

| | | | |
|---|---|---|---|
| 3,159,008 | 12/1964 | Nebgen | 62/500 |
| 3,427,817 | 2/1969 | Rietdijk | 62/191 |
| 3,434,298 | 3/1969 | Rietdijk | 62/500 |
| 3,442,093 | 5/1969 | Rietdijk | 62/500 |
| 3,447,339 | 6/1969 | Rietdijk | 62/500 |
| 3,456,456 | 7/1969 | Rietdijk | 62/500 |
| 3,464,230 | 9/1969 | Rietdijk | 62/500 |
| 3,496,735 | 2/1970 | Haisma | 62/191 |
| 3,932,158 | 1/1976 | Hildebrandt | 62/500 |

*Primary Examiner*—Ronald C. Capossela

*Attorney, Agent, or Firm*—Kenyon & Kenyon

[57] ABSTRACT

An ejector is used in place of a compressor with moving parts in the refrigeration apparatus. The ejector has an intake side connected to the gas space of a liquefied gas tank, a propellant jet input connected to a delivery side of the compressor to receive a high pressure flow of gas and a delivery side in the form of a diffusor output connected to the intake side of the compressor. A pair of ejectors can be connected in series or, where more than two liquefied gas tanks are used, in parallel.

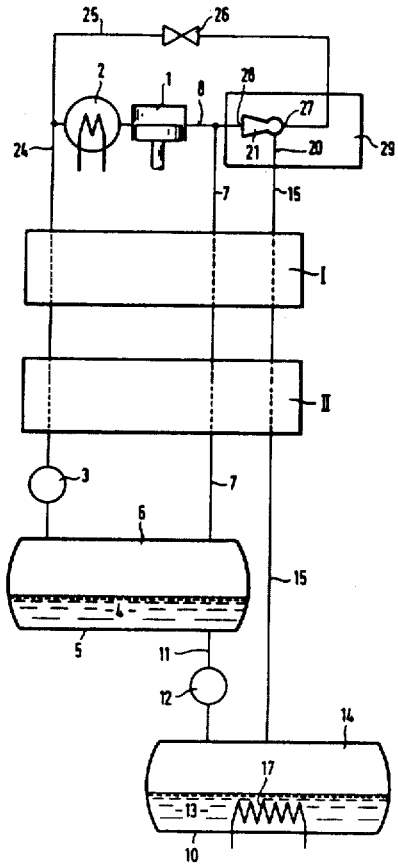

8 Claims, 5 Drawing Figures